United States Patent [19]

Kellogg

[11] 3,983,348

[45] Sept. 28, 1976

[54] SWITCH OPERATOR

[75] Inventor: Walter J. Kellogg, Beaver, Pa.

[73] Assignee: Westinghouse Electric Corporation, Pittsburgh, Pa.

[22] Filed: Apr. 16, 1974

[21] Appl. No.: 461,331

[52] U.S. Cl. ..... 200/314; 200/313

[51] Int. Cl.[2] ..... H01H 9/18

[58] Field of Search ..... 200/313, 314, 315, 316

[56] References Cited

UNITED STATES PATENTS

| | | | |
|---|---|---|---|
| 2,914,705 | 11/1959 | Krystyan et al. | 317/99 |
| 3,040,142 | 6/1962 | Dietrich | 200/314 |
| R26,936 | 8/1970 | Waldorf | 200/314 |

*Primary Examiner*—Robert K. Schaefer
*Assistant Examiner*—John W. Redman
*Attorney, Agent, or Firm*—L. P. Johns

[57] ABSTRACT

A switch operator characterized by a tubular base, a tubular member movably mounted within the base, biasing means for holding the member in an inoperative position, a tubular manual knob detachably mounted on the member, the knob having an outer closed end portion, a switch unit including a contact operator adjacent the end of the member opposite the knob, the contact operator being operable by the member upon movement of the knob, and sealing means at least between the tubular base and tubular member.

9 Claims, 3 Drawing Figures

SWITCH OPERATOR

BACKGROUND OF THE INVENTION

1. Field of the Invention

This invention relates generally to switch operators and more particularly to switch operators of the type having readily interchangeable parts.

2. Description of the Prior Art

Switch operators or actuators are usually employed to actuate associated electrical devices, such as switches, and reset devices including thermostatic units of the type that are commonly included with motor starters. For example, switch operators or actuators are disclosed in U.S. Pat. Nos. 3,333,079, 3,511,955 and 3,367,206. Other types of pushbutton operators are also known. Moreover, in certain types of control systems, such as motor control, it is necessary to provide a contact block and switch operator as separate structures. With this arrangement, the contact block is preferably mounted within an enclosure and a switch operator is mounted externally of the enclosure for easy access on the enclosure cover.

Associated with the foregoing are a number of problems including oil leakage between the enclosure panel and the switch, an indicating lamp in the switch which becomes inoperative during operation of the switch operator, and the difficulty of replacement or conversion of parts of the switch operator for alternate functions.

SUMMARY OF THE INVENTION

Generally, it has been found in accordance with this invention that the foregoing problems may be overcome by providing a switch operator comprising a tubular base having an inturned flange, a tubular contact operator movably mounted within the base and having an outturned shoulder, bias means biasing the shoulder against the inturned flange, tubular manual means detachably mounted on said operator for manually moving the actuator within the tubular base, the tubular manual means having an outer closed end portion, a switch unit including a contact operator adjacent the end portion of said actuator opposite said tubular manual means, means including said end portion for actuating the contact operator upon movement of said manual means, the tubular means being in threaded engagement with the actuator, first seal means between the tubular base and the actuator, second seal means between the tubular base and the tubular manual means, the outer closed end portion being translucent, and indicator light unit within the contact actuator.

The advantage of the device of this invention is that the tubular manual means or knob is readily accessible and operable without effecting operation of the indicator lamp, that frontal vision is provided for the lamp, that means for actuating the contact operator which may comprise a cam surface cannot be displaced in operation but is readily replaced when necessary.

DESCRIPTION OF THE PREFERRED EMBODIMENTS

Figure 1:
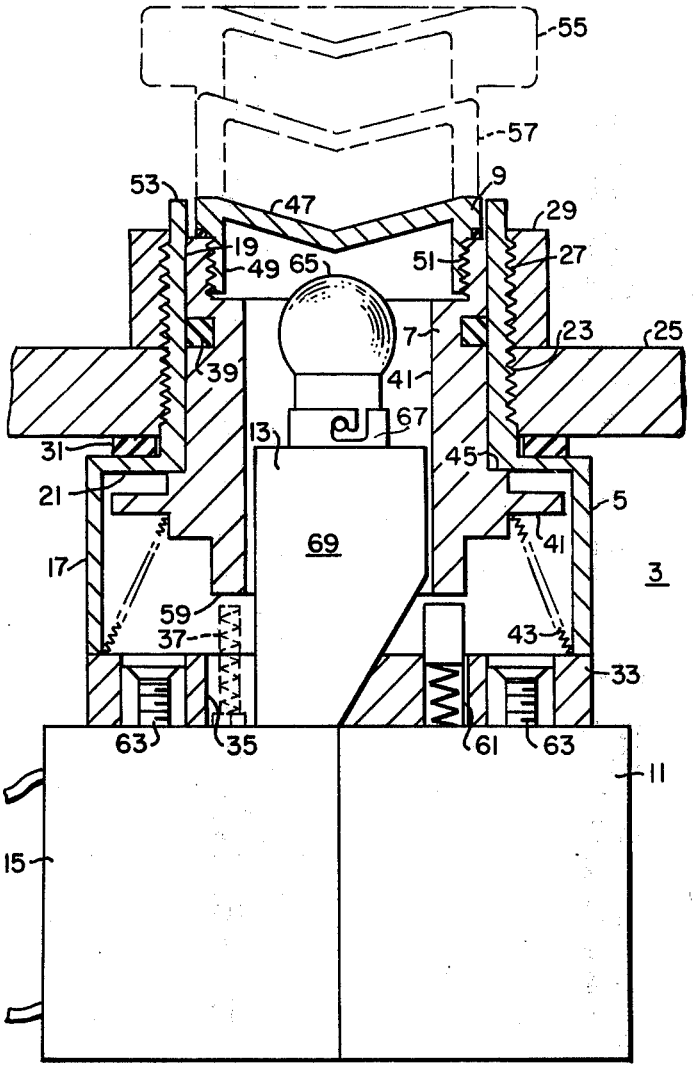
FIG. 1 is a vertical sectional view partly in elevation of a combined pushbutton switch unit and indicating lamp embodying the principle features of the invention.

In FIG. 1 a pushbutton type of switch structure is generally indicated at 3 and it comprises a base or housing 5, a contact actuator 7, an end cap or lens 9, a contact block 11, and an indicating lamp assembly 13 including a transformer unit 15.

The base 5 is a tubular member including an enlarged portion 17 and a reduced portion or sleeve 19. An inturned flange 21 extends between the portions 17 and 19. The reduced base portion 19 extends through an aperture 23 in a panel 25 of an enclosure. The reduced base portion 19 is externally threaded at 27 for receiving a similarly threaded clamping ring 29 for clamping the panel 25 between the ring and a suitable oil-tight seal or gasket 31. An end closure 33 having a central opening 35 is secured to the lower open side of the base portion 17 by suitable means such as spaced screws 37 one of which is shown in FIG. 1.

The contact actuator 7 is preferably a tubular member slidably mounted within the reduced base portion 19 and is provided with suitable oil-tight sealant such as a gasket or seal 39. The contact actuator 7 also includes an outturned flange 41 and biasing means or spring 43 extends between the flange and the end closure 33 for holding a shoulder 45 against the inturn flange 21 when the switch structure 3 is in the operative position.

Inasmuch as the contact actuator 7 is a tubular member, its upper open end is closed by the end cap or lens 9 which includes a web portion 47 and a tubular portion 49 which is attached to the upper end portion of the bore 41 in a suitable manner such as interfitting threaded portions 51. The switch structure 3 may be used either as a stop, start, or reset switch. Where the switch is used as a start button, the end cap including the web 47 is preferably disposed in a flush position with the outer end 53 of the actuator 7 to prevent accidental starting. Where, on the other hand, the switch structure 3 is used as a stop switch, the end cap 9 preferably extends outwardly beyond the outer end 53 and has an enlarged size similar to a mushroom for easy access. Where the switch structure 3 is used as a reset button for cyclic operation, the end cap 9 may be only partially extended, such as shown at 57, to a position where it is more readily accessible than in the recessed position, but less accessible for the stop position 55.

When the end cap 9 is pressed downwardly, a lower end 59 of the contact actuator engages a contact operator or button 61 which extends from the contact block 11. The contact block 11 as well as the transformer unit 15 are attached to the switch structure 3 in a suitable manner, such as by screws engaging recessed threaded inserts 63. The particular construction of the contact block 11 comprises a pair of separable contacts which may be normally closed or normally open and one embodiment of the contact block 11 is shown, for example in U.S. Pat. No. 3,511,955. The contact operator 61 actuates the contacts to the closed or open position in a conventional manner.

Where the switch structure 3 is combined with an indicating lamp 65, the lamp assembly 13 is disposed within the bore 41 as shown in FIG. 1. More particularly, the lamp assembly 13 comprises the indicating lamp 65, a lamp receptacle 67, and an upright member 69 which extends from the transformer unit 15. In addition, the end cap 9 is preferably a lens or translucent member, whereby it is readily apparent to an operator that the lamp is on or off to indicate some position or condition of the electrical apparatus to which the switch structure 3 is connected.

Another embodiment of the invention is a switch structure 71 (FIG. 2) which is a rotary selector switch as distinguished from the longitudinally movable or pushbutton switch structure 3 of FIG. 1. The switch structure 71 comprises a base or housing 73, a contact actuator 75, a knob 77, an end cap or lens 79, and a cylindrical camming member 81. In addition, the switch structure 71 comprises a lamp assembly 83 including a transformer unit 85 and a contact block 87 having a contact operator or button 89.

The base 73 is a tubular member having an enlarged base portion 91, a reduced portion 93, and an inturned flange 95. The upper end of the reduced portion 93 comprises an inturned flange 97.

The contact actuator 75 is a tubular member which is rotatably mounted within the reduced portion 93 of the base and included an outturned surface 99 which is biased against the inturned flange 97. Oil-tight sealing means, such as a seal 101, is disposed between the contact actuator 75 and the reduced portion 93. In addition, the contact actuator 75 includes an upper portion 103 which extends through an opening 104 formed by the inturned flange 97 and into the lower portion of the knob 77. The inner surface of the upper portion 103 comprises detachable mounting means such as a threaded surface 105 which is engageable with a corresponnding surface on a tubular or sleeve portion 107 of the end cap 79. The end cap 79 includes an outturned portion or flange 109 which abuts an inturned surface of the knob 77 for retaining the knob in place.

Figure 3:
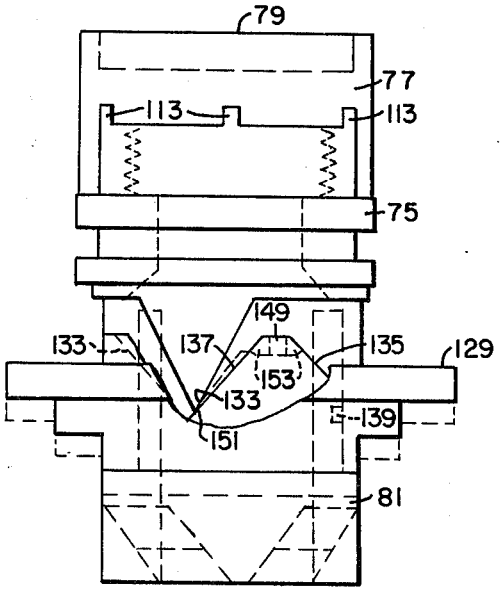
FIG. 3 is a vertical sectional view taken on the line III—III of FIG. 2.

Moreover, as shown more particularly in FIG. 3, the upper portion 103 comprises interfitting members or spaced projections 113 which are seated in projection-receiving notches 115 of the knob 77. In the alternative, similar projections 113 and notches 115 may be provided in the upper portion 103 and the knob 77, respectively. Thus manual rotation of the knob is transmitted to the projections 113 to the contact actuator 75. An annular seal 117 is disposed between the tubular portion 107 and the contact actuator 75 to provide an oil-tight fit therebetween.

Figure 2:
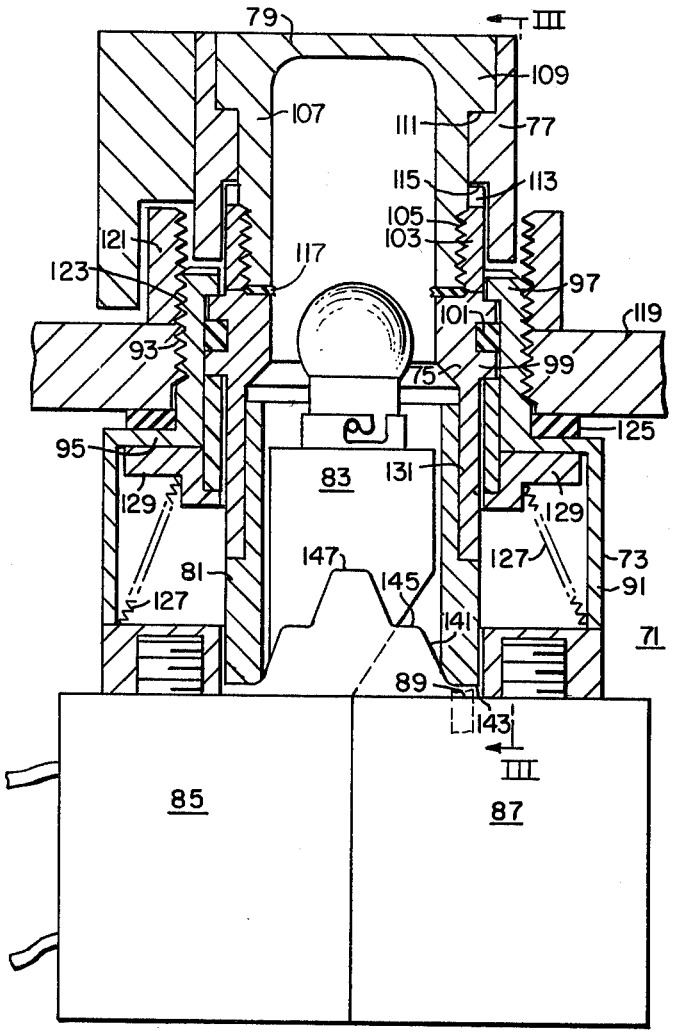
FIG. 2 is a similar view of another embodiment of the invention.

As shown in FIG. 2 the reduced portion 93 extends through an aperture in a panel of 119 of an enclosure where it is retained in place by a clamping ring 121 which is detachably mounted on the outer surface of the reduced portion in a suitable manner such as by threaded portions 123. An annular seal 125 is disposed between the inturned flange 95 and the panel 119 to prevent leakage of oil from one side of the panel to the other.

As shown more particularly in FIG. 2 biasing means including a coil spring 127 and a biasing ring 129 are provided to return the contact actuator 75 to the inoperative position upon release of the manual knob 77. For that purpose, as shown in FIG. 3, a lower portion 131 of the cam actuator 75 includes at least one and preferably two diagonally opposite cam followers extending from the outer surfaces thereof. Likewise, at least one or preferably two corresponding cam surfaces 135, 137 are provided on the upper side of the biasing ring 129. The camming surface of 135, 137 are inclined at an angle to the axis of rotation of the cam actuator 75. Upon rotation of the cam actuator 75 the cam followers 133 move against the inclined cam surfaces 135, 137 to cause the biasing ring 129 to yield downwardly against the spring 127 at the same time the camming member 81, being seated within the lower portion 131 of the cam actuator 75 is rotated thereby due to a projection or pin 139 which extends inwardly from the lower portion 131 into a vertical slot (not shown) in the camming member 81. Accordingly, rotation of the contact actuator 75 moves a camming surface 141 over the contact operator or button 89 to open or close contacts (not shown) within the contact block in a manner set forth above with respect to the contact block 11. The camming surface 141 may be of any configuration suitable for accomplishing the desired purpose. For example, where the contact block 87 contains two separable contacts, the camming surface 141 may comprise two plateaus 143, 145 to which the contact operator or button 89 is movable by spring biasing means (not shown). Where three contacts are involved, a third plateau 147 is provided for another control function or combination of contacts. Moreover, the cam surfaces 135, 137 being continuously inclined members extending between a plateau 149 and valley 151 provide a instantaneous type of contact, whereby rotation of the knob 77 in a counterclockwise direction may cause an associated electrical device, such as a motor, to start while rotation of the knob is the clockwise direction will stop operation of the associated electrical device. The foregoing structure provides for a "momentary" switch operation, whereby upon release of the knob 77 the biasing ring 129 returns the switch to the normal position.

On the other hand, the switch structure may be used as a "maintained" switch by providing notches 153 at the upper end of one or both of the inclined cam surfaces 135 and 137. Thus, upon rotation of the knob 77 a sufficient distance in either clockwise or counterclockwise direction to cause the cam followers to ride into the appropriate notch 153. The switch remains locked in the position to which it is rotated, and is unaffected by the force applied by the spring 127 and the biasing ring 129. Manifestly, return of the switch structure to the normal position is obtained by manually turning the knob 77 in the reversed direction till the cam followers 133 are dislodged from the notches 153.

Finally, as shown in FIG. 2, the switch structure 71 may be provided with an indicator light which includes a lamp assembly 83 and a transformer unit 85 similar to the lamp assembly 13 and a transformer unit 15 in FIG. 1. For that purpose the end cap or lens 79 is composed of a translucent material.

Accordingly, the device of the present invention provides a new and novel switch structure which enables the operation of a switch without effecting the indicator light and at the same time the switch may be operated without disengaging the end cap or lens. Although the switch structure is so constructed that the cam cannot be displaced during operation, it can nevertheless be replaced where a change in function of the switch is required.

What is claimed is:

1. A switch operator comprising a tubular base comprising an enlarged portion and a reduced portion having an inturned flange therebetween, a tubular contact actuator movably mounted within the base and having an outturned shoulder, bias means biasing the shoulder in abutment with the inturned flange and disposed on the side of the outturned flange opposite the outturned flange, tubular manual means detachably mounted on said actuator for manually moving said actuator within the tubular base, the tubular manual means having an outer closed end portion, the reduced portion and the tubular contact actuator being in surface-to-surface contact substantially throughout the length of the actuator between the outturned shoulder and the outer closed end portion, said actuator extending into and being enclosed within the enlarged portion on the side of the shoulder opposite the flange, a switch unit including a contact operator adjacent the end portion of said actuator opposite said tubular manual means, and means including said end portion for actuating the contact operator upon movement of said manual means.

2. The switch operator of claim 1 in which the tubular means is detachably mounted within said actuator.

3. The switch operator of claim 2 in which the tubular means is in threaded engagement with said actuator.

4. The switch operator of claim 1 in which a first seal is disposed between the tubular base and said actuator.

5. The switch operator of claim 4 in which a second seal is disposed between the tubular base and the tubular means.

6. The switch operator of claim 1 in which the outer closed end portion is translucent.

7. The switch operator of claim 1 in which said actuator is movable axially.

8. A switch operator comprising a tubular base comprising an enlarged portion and a reduced portion and having an inturned flange therebetween, a tubular plunger axially movable within the base and having an outturned shoulder abuttable with the inturned flange, bias means biasing the outturned shoulder against the inturned flange and disposed on the side of the outturned flange opposite the outturned flange, a seal between the tubular base and the plunger and seated within a peripheral groove in the plunger, tubular means detachably mounted on the tubular plunger for manually moving the plunger against the biasing means, the tubular means having an outer translucent closed end portion, the reduced portion and the tubular contact actuator being in surface-to-surface contact substantially throughout the length of the actuator between the outturned shoulder and the outer closed end portion, said actuator extending into and being enclosed within the enlarged portion on the side of the shoulder opposite the flange, a switch unit including a contact operator adjacent the end portion of the plunger opposite the tubular means, and means including said end portion for actuating the contact operator upon movement of said tubular means and plunger.

9. The switch operator of claim 8 in which the outer closed end portion is disposed beyond the tubular base.

* * * * *